US006064349A

United States Patent [19]

Robertson

[11] Patent Number: 6,064,349

[45] Date of Patent: May 16, 2000

[54] ELECTRONICALLY SCANNED SEMICONDUCTOR ANTENNA

[75] Inventor: Ralston S. Robertson, Northridge, Calif.

[73] Assignee: Hughes Electronics Corporation, El Segundo, Calif.

[21] Appl. No.: 09/023,450

[22] Filed: Feb. 13, 1998

[51] Int. Cl.[7] ..... H01Q 13/00; H01Q 3/00

[52] U.S. Cl. ..... 343/772; 343/757; 343/762; 343/776

[58] Field of Search ..... 343/772, 762, 343/757, 776, 700 MS

[56] References Cited

U.S. PATENT DOCUMENTS 5,583,524 12/1996 Milroy ..... 343/772
5,652,596 7/1997 Abrams et al. ..... 343/754

*Primary Examiner*—Don Wong
*Assistant Examiner*—Hoang Nguyen
*Attorney, Agent, or Firm*—Michael W. Sales

[57] ABSTRACT

An electronically scanned antenna that is manufactured using semiconductor material and device fabrication technology. The antenna has a semiconductor substrate having a plurality of stubs projecting from one surface. The semiconductor substrate may be silicon, gallium arsenide, or indium phosphide, for example. A first conductive layer formed on the surfaces of the semiconductor substrate and along sides of the stubs so that the stubs are open at their terminus. The conductive layers form a parallel plate waveguide region. A diode array having a plurality of diode elements is formed in the semiconductor substrate that are disposed transversely across the semiconductor substrate and longitudinally down the semiconductor substrate between selected ones of the plurality of stubs. The diode array may comprise an array of Schottky or varactor diodes, for example. The diode array provides a voltage variable capacitive reactance and hence a phase shift to the electromagnetic energy propagating in selective regions of the waveguide region. This results in a scanning of the antenna beam radiated from the studs. A beam steering computer is coupled to the plurality of diode elements of the diode array which controls the voltage applied thereto to control steering of a beam radiated by the antenna.

13 Claims, 2 Drawing Sheets

ELECTRONICALLY SCANNED SEMICONDUCTOR ANTENNA

BACKGROUND

The present invention relates generally to electronically scanned antennas, and more particularly, to an electronically scanned semiconductor antenna.

Conventional, electronically scanned arrays and phased arrays are realized in two geometries, including a passive electronically scanned array using ferrite phase shifters, and an active electronically scanned array using transceiver modules. At millimeter-wave frequencies, the center-to-center antenna element spacing ranges from 0.200 inches at Ka-band to 0.060 inches at W-band. Within a square cross-section of this dimension, an active transceiver module or a reciprocal phase shifter assembly must be mounted and control lines must be made accessible.

In order to illustrate the magnitude of this antenna design problem, consider as an example a 25×25, fully populated Ka-band active electronically scanned array. Also assume five power and signal control lines are needed per antenna element. This means that 625 modules must be packaged with 3,125 power and control lines, a 625 way RF power divider network and sufficient heat sinking to dissipate the heat from the modules. The present invention will reduce considerably the amount of hardware necessary for a millimeter-wave phased array.

Conventional, electronically scanned, phased arrays are not yet practical for millimeter-wave applications. The center-to-center element spacing, 0.060 inches at W-band (94 GHz) and 0.100 inches at V-band (60 GHz) and 0.200 inches at Ka-band (35 GHz), is not conducive to the packaging of such arrays. Passive ferrite phase shifters above Ka-band (35 GHz) have only recently become available and are generally lossy, current controlled devices and active transceiver modules are in their infancy of development. W-band transmit/receive module electronically scanned array antennas are not feasible with conventional technology.

Accordingly, it is an objective of the present invention to provide for an electronically scanned semiconductor antenna.

SUMMARY OF THE INVENTION

To meet the above and other objectives, the present invention provides for an electronically scanned semiconductor antenna that is manufactured using conventional semiconductor device fabrication technology. The antenna is fashioned in the form of a continuous transverse stub array geometry but uses a semiconductor substrate, such as silicon, gallium arsenide, or indium phosphide, for example.

The antenna has a semiconductor substrate having a plurality of stubs projecting from one surface. The semiconductor substrate may be silicon, gallium arsenide, or indium phosphide, for example. A first conductive layer formed on the surfaces of the semiconductor substrate and along sides of the stubs so that the stubs are open at their terminus. The conductive layers form a parallel plate waveguide region. A diode array having a plurality of diode elements is formed in the semiconductor substrate that are disposed transversely across the semiconductor substrate and longitudinally down the semiconductor substrate between selected ones of the plurality of stubs. The diode array provides a voltage variable capacitive reactance in selective regions of the waveguide region. A beam steering computer is coupled to the plurality of diode elements of the diode array which controls the voltage applied thereto to control steering of a beam radiated by the antenna.

As in the continuous transverse stub antenna, the electromagnetic energy is launched from one end of the array and selectively coupled into the transverse stubs. The radiation pattern is set by the dimensions of transverse stubs projecting from the substrate relative to a parallel plate waveguide region and the free space wavelength, $I_0$, as it pertains to the element spacing. Between the stub locations, a continuous or discrete pattern of Schottky diodes or PN-junction varactor diodes is fabricated in the semiconductor substrate. The voltage variable capacitance of these simple elements is used to cause a phase shift as the energy propagates between the stub radiators. This phase shift results in the two-dimensional scanning of an antenna beam pattern produced by the antenna.

The novelty of the present invention involves the use of the Schottky or varactor diode pattern within the transmission medium, and the use of a semiconductor transmission medium for the antenna. Since a Schottky junction is a metal-semiconductor junction, fabrication costs are low. The radiation elements and the precise location of the elements is achieved using conventional photolithographic techniques and active device geometry is easily achieved compared to transistor (HEMT, FET, HBT, and bipolar) designs.

The present antenna provides the ability to cost effectively manufacture electronically scanned arrays in the millimeter-wave bands. The present invention provides an antenna for use in small diameter, millimeter-wave, active radar sensor missiles, collision avoidance radars for automobiles and other vehicles, and millimeter-wave communication links for use on satellites.

The present electronically scanned semiconductor antenna provides a feasible and practical means for achieving two-dimensional electronic radiation pattern scanning for millimeter-wave radars that are confined to small apertures. The present antenna provides two-dimensional scanning capability and takes advantage of existing semiconductor material fabrication technology. Since the preferable material of choice for use in the present antenna is silicon, the insertion loss of the antenna should be very low compared to other more exotic materials.

Additionally, this present invention incorporates the scanning mechanism directly in the bulk semiconductor antenna. Using the precision of monolithic microwave integrated circuit fabrication techniques, element spacing and antenna geometry may be realized in a cost effective manner. Beam steering control line packaging is considerably simplified using readily-available LSI packaging techniques.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
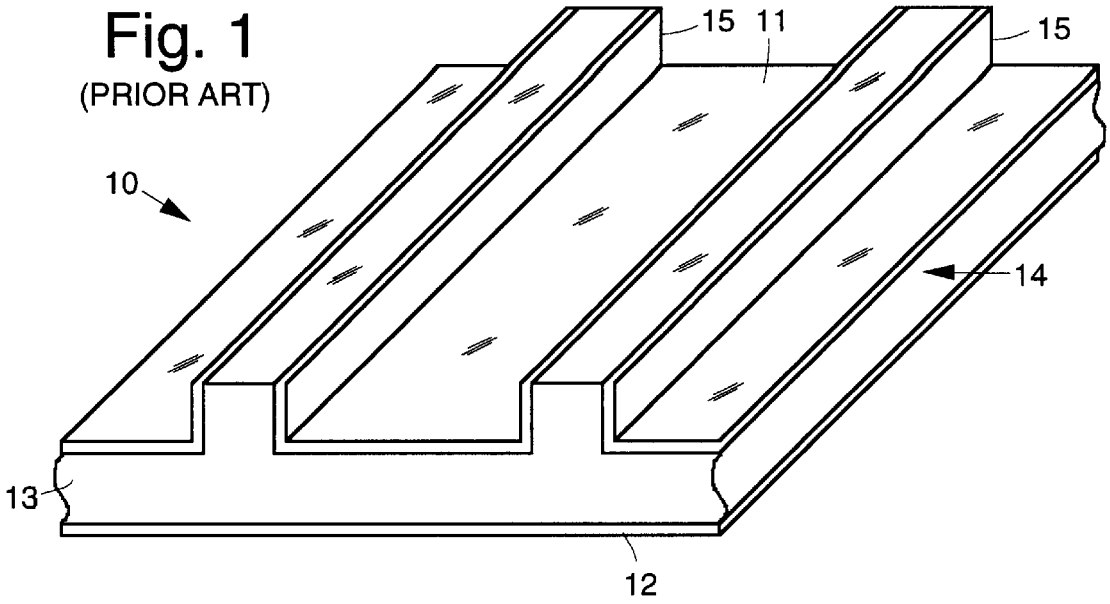
Fig. 1 (PRIOR ART)
FIG. 1 illustrates a portion of a conventional continuous transverse stub array antenna.

Referring to the drawing figures, FIG. 1 illustrates a conventional continuous transverse stub array antenna 10 developed by the assignee of the present invention. The present invention builds upon the geometry of the continuous transverse stub array antenna 10 developed by the assignee of the present invention. However, the present invention incorporates a unique technology and mechanization to provide a two-dimensional electronic scan mechanism for microwave and millimeter-wave antennas.

In its basic geometry, the continuous transverse stub antenna 10 is fabricated from conventional dielectric material 13, usually a plastic material, such as Rexolite, for example. Top and bottom surfaces 11, 12 of the antenna 10 are plated with conductive material to form a parallel plate waveguide medium that provides a feed system 14 for energy propagation. Parallel plate waveguide stubs 15 are oriented transverse to the parallel plate feed system 14, plated on the sides, but open at their terminus. The propagating wave in the feed system 14 encounters transverse stubs 15 which couple off energy in a prescribed manner to achieve the desired radiation pattern of the antenna 10.

Figure 2:
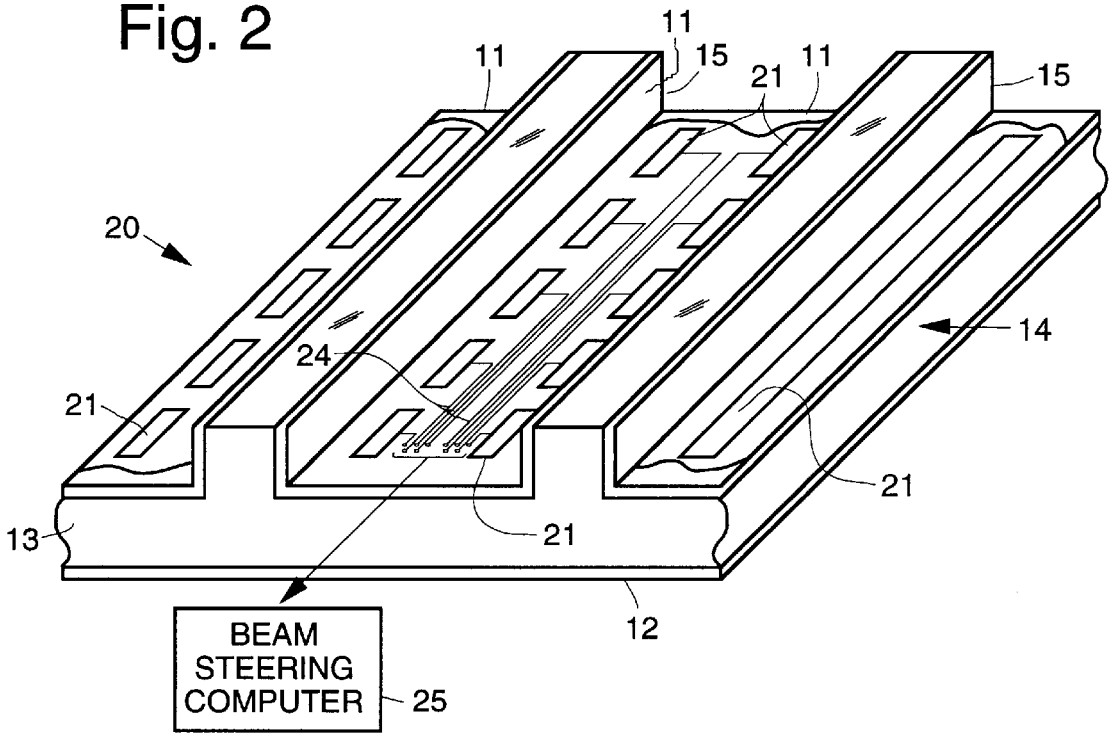
FIG. 2 illustrates a portion of an electronically scanned semiconductor antenna in accordance with the principles of the present invention which improves upon the array of FIG. 1.

Referring now to FIG. 2, it illustrates a portion of an electronically scanned semiconductor antenna 20 in accordance with the principles of the present invention which improves upon the array of FIG. 1. The geometry of the continuous transverse stub antenna 10 is used in the present antenna 20, except that the present antenna 20 is fabricated using an appropriate bulk semiconductor material as a substrate 13. The semiconductor material may include silicon, gallium arsenide, and indium phosphide, for example. Silicon is believed to be the most cost effective material of choice, given the maturity of silicon technology used in the computer industry. As with a conventional continuous transverse stub antenna 10, in the present antenna 20, transverse stubs 15 comprised of semiconductor material project from the surface of the semiconductor wafer. Plating material (the majority of which is shown removed to expose the underlying semiconductor material) covers the top and bottom surfaces 11, 12 to establish the parallel plate waveguide region 14.

Ridges 15 or stubs 15 are fabricated using photolithographic and semiconductor etching techniques. In the open areas between the ridges 15, the plating material or semiconductor doping is controlled so as to fabricate a Schottky or varactor diode array 21 in a discrete or continuous sense across and down the propagation medium comprising the semiconductor material. The Schottky or varactor diode array 21 provides a voltage variable capacitive reactance in selective regions across the waveguide region 14. The voltage variable capacitive reactance provides a means to shift the phase of the incident energy, which was launched into the waveguide region.

Figure 3:
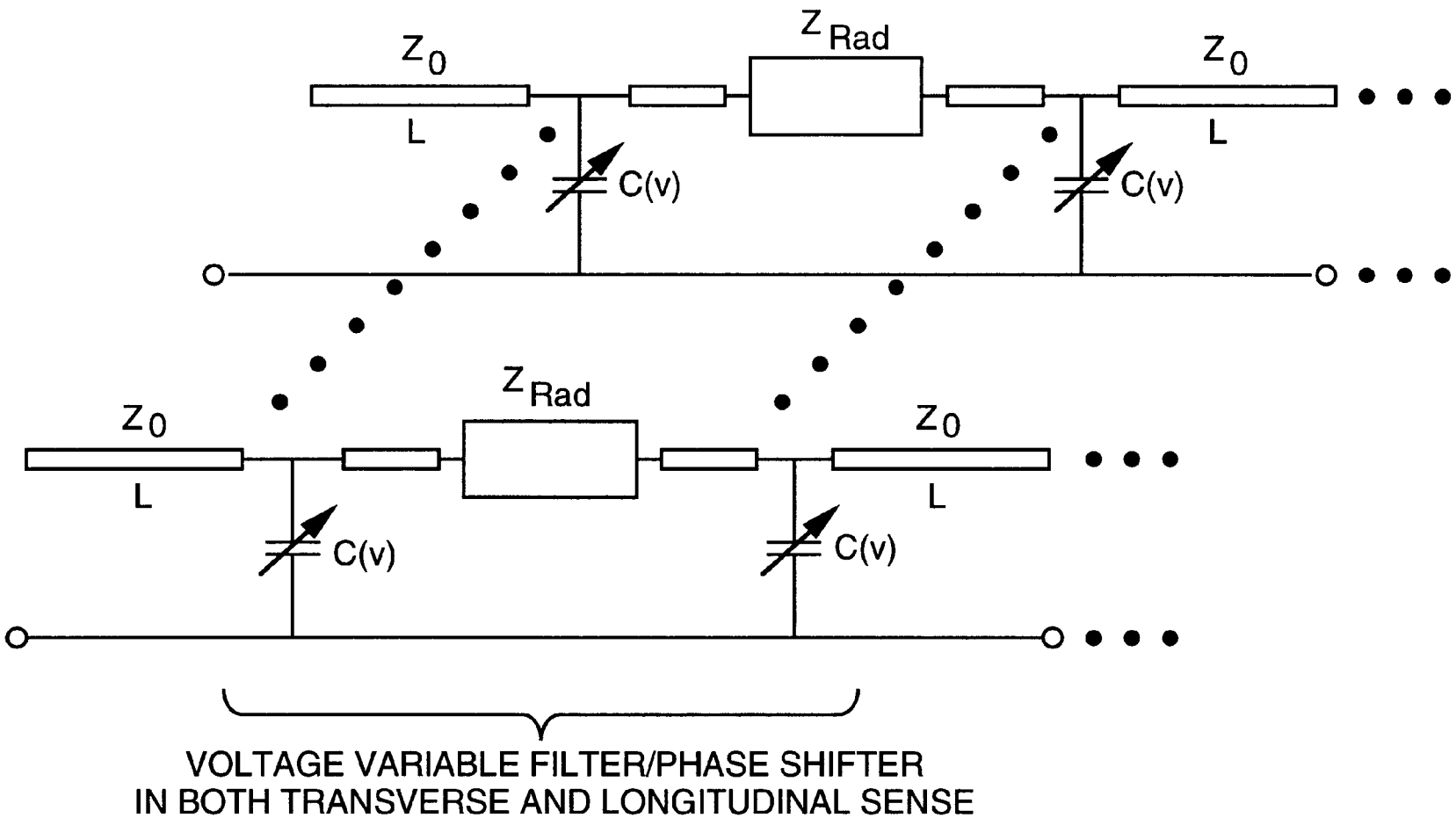
FIG. 3 illustrates beam steering equivalent circuit mechanism in the electronically scanned semiconductor antenna of FIG. 1.

To first order, this arrangement of diode arrays 21 provides for a set of voltage variable, distributed filter and phase shifter networks cascaded down and across the parallel plate waveguide region 14 which forms a transmission line. This is illustrated in FIG. 3. Schottky diodes employ a metal contacted to an N-type semiconductor. N-type semiconductor and p-type doping provide a suitable propagation medium. Additionally, both Schottky and varactor diodes exhibit a continuous capacitance versus voltage characteristic which provides a continuous reactance control feature. The reverse bias nature of the devices requires literally no control current (typically microamperes) only a voltage change; this feature makes control of the diode array 21 convenient and easy to accomplish. Furthermore the diode arrays 21 have an exceptionally fast response time (nanoseconds). The diode arrays 21 require voltages no larger than 40 volts, and thus no high voltage power supply is required.

It has already been demonstrated by the assignee of the present invention that a canted transverse phase front provides an H-plane scan mechanism. In the present antenna 20, the phase shift can be adjusted in both the transverse and longitudinal axis to affect both the E- and H-plane scanning mechanisms. Thus, a two-dimensional passive electronic scan is provided by the present antenna 20.

Two modes of operation exist to affect the 2-dimensional scan. By constructing a line of individual Schottky or varactor diodes 21 across the width of the antenna 20 (transverse axis), independent voltage controlled, localized reactance is encountered by the propagating energy in the transverse plane. This single line of diode arrays 21 cause varying localized phase shifts across the arrays 21 at the point of the line feed. The result is the canting of the phase front and therefore scanning of the beam in the H-plane.

Next, if the Schottky and varactor diode arrays 21 are fabricated as either a discrete or continuous linear region parallel to the stubs but cascaded down the longitudinal axis of the arrays 21, the propagating wave encounters uniform reactance networks transverse to the direction of energy propagation. The resultant phase shift may be controlled to provide the E-plane beam scan in the cross dimension. Thus, the effective longitudinal electrical length of the antenna 20 is changed and is continuously variable.

By varying the voltage across for a first line of diode arrays 21, the beam scans in the H-plane. By varying the voltage down the diode arrays 21, the beam scans in the E-plane. The continuous variable reactance feature with low voltage provides continuous beam steering control. Multiple diode arrays 21 and values are appropriately selected and designed to provide adequate input impedance matching at the line feed input.

The fabrication of diode arrays 21 using such techniques as molecular beam epitaxy or ion beam implantation is simple compared to the complex monolithic microwave integrated circuits built by the assignee of the present invention. Precise location, doping profiles and circuit interconnection are readily available; some oxide layers may be employed to achieve isolated bias lines. Beam steering control pads may be placed along edges of the antenna 20 for coupling to a beam steering computer 25. High rate interconnect technology applies directly. Only low voltage power supplies with little current requirement are needed.

As an example of the present invention, consider the design of a W-band antenna. The radiator element (stub 15 or ridge 15) spacing is less than 0.060". Conventional phased array technology is not feasible from a packaging geometry perspective. The present invention is ideal for small aperture (2–3 inch diameter) applications where electronic two-dimensional scanning is required. Silicon wafer fabrication sizes, available with today's reactor sizes for high rate computer chip production, provide significant antenna gains at the millimeter-wave frequencies. The present invention thus provides a cost effective option for two-dimensional electronically scanned millimeter-wave antennas, heretofore, not available.

Thus, an improved electronically scanned semiconductor antenna has been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. Antenna apparatus comprising:

a semiconductor substrate having a first surface and an second surface having a plurality of stubs projecting therefrom;

a first conductive layer formed on the first surface of the semiconductor substrate;

a second conductive layer formed on the second surface of the semiconductor substrate and along sides of the plurality of stubs projecting from the semiconductor substrate so that the stubs are open at their terminus, and wherein the first and second conductive layers form a parallel plate waveguide region; and a diode array comprising a plurality of diode elements formed in the semiconductor substrate that are disposed transversely across the semiconductor substrate and longitudinally down the semiconductor substrate between selected ones of the plurality of stubs, which diode array provides a voltage variable capacitive reactance in selective regions of the waveguide region.

2. The antenna apparatus of claim 1 wherein the plurality of diode elements of the diode array are coupled to a beam steering computer which controls the voltage applied thereto to control steering of a beam radiated by the antenna.

3. The antenna apparatus of claim 1 wherein the diode array comprises an array of Schottky diodes.

4. The antenna apparatus of claim 1 wherein the diode array comprises an array of varactor diodes.

5. The antenna apparatus of claim 1 wherein the semiconductor substrate comprises silicon.

6. The antenna apparatus of claim 1 wherein the semiconductor substrate comprises gallium arsenide.

7. The antenna apparatus of claim 1 wherein the semiconductor substrate comprises indium phosphide.

8. An electronically scanned antenna comprising:

a semiconductor substrate having a first surface and an second surface having a plurality of stubs projecting therefrom;

a first conductive layer formed on the first surface of the semiconductor substrate;

a second conductive layer formed on the second surface of the semiconductor substrate and along sides of the plurality of stubs projecting from the semiconductor substrate so that the stubs are open at their terminus, and wherein the first and second conductive layers form a parallel plate waveguide region;

a diode array comprising a plurality of diode elements formed in the semiconductor substrate that are disposed transversely across the semiconductor substrate and longitudinally down the semiconductor substrate between selected ones of the plurality of stubs, which diode array provides a voltage variable capacitive reactance in selective regions of the waveguide region; and a beam steering computer coupled to the plurality of diode elements of the diode array which controls the voltage applied thereto to control steering of a beam radiated by the antenna.

9. The antenna of claim 8 wherein the diode array comprises an array of Schottky diodes.

10. The antenna of claim 8 wherein the diode array comprises an array of varactor diodes.

11. The antenna of claim 8 wherein the semiconductor substrate comprises silicon.

12. The antenna of claim 8 wherein the semiconductor substrate comprises gallium arsenide.

13. The antenna of claim 8 wherein the semiconductor substrate comprises indium phosphide.

* * * * *